US006622406B2

(12) United States Patent
Usher et al.

(10) Patent No.: US 6,622,406 B2
(45) Date of Patent: Sep. 23, 2003

(54) READING MACHINE

(76) Inventors: Adine Ray Usher, 157 Stone Oaks Dr., Hartsdale, NY (US) 10530; James W. Cobb, 70 S. Broadway, Tarrytown, NY (US) 10591

( * ) Notice: Subject to any disclaimer, the term of this patent is extended or adjusted under 35 U.S.C. 154(b) by 0 days.

(21) Appl. No.: 09/975,422

(22) Filed: Oct. 11, 2001

(65) Prior Publication Data

US 2003/0070333 A1 Apr. 17, 2003

(51) Int. Cl.[7] ..... B41J 11/62
(52) U.S. Cl. ..... 40/352; 40/353; 40/472
(58) Field of Search ..... 40/352, 353, 356, 40/472, 487, 524, 525; 248/444.1, 450, 451, 453; 400/706, 707, 707.2, 707.3, 709.1

(56) References Cited

U.S. PATENT DOCUMENTS 3,449,850 A * 6/1969 Eckert ..... 40/356
3,803,971 A * 4/1974 del Castillo ..... 84/484
4,365,431 A * 12/1982 Klaus et al. ..... 40/352
4,558,527 A * 12/1985 Schroedel et al. ..... 40/343
5,088,217 A * 2/1992 Canaday ..... 40/356
5,414,946 A * 5/1995 Leon ..... 40/353

* cited by examiner

*Primary Examiner*—Brian K. Green
(74) *Attorney, Agent, or Firm*—Grimes & Battersby, LLP

(57) ABSTRACT

A reading machine is provided comprising a carriage for temporarily receiving and retaining a publication such as a book, magazine or printed sheet, which carriage is slidably inserted into tracks supported by the main body of the reading machine so as to allow horizontal movement of the carriage relative to the main body of the reading machine. A continuous belt is supported by roller bearings disposed about the main body of the reading machine such that the belt covers the carriage when the carriage is attached to the reading machine. The belt includes a horizontal member having an opening therein, which opening extends through the belt itself and being of substantially the same size of a line of text such that the opening and belt may be used to isolate individual lines of text. The machine includes a control device for manually or automatically controlling the vertical displacement of the belt and the horizontal member by an electric motor or by a knob or handle.

18 Claims, 4 Drawing Sheets

READING MACHINE

BACKGROUND OF THE INVENTION

1. Field of the Invention

The present invention relates generally to a reading machine and, more particularly, to such a machine that is designed to allow young or adult readers to isolate individual lines of text in a book, magazine or printed sheet. The invention has particular applicability for people with reading disabilities that have difficulty filtering out or blocking words or characters from lines of text above or below the line of text being read. Such disability may be overcome by effectively removing all lines of text but for the single line of text being read on the page. The invention allows the user to scroll between adjacent lines of text on the page, either manually or automatically.

The reading machine of the present invention is designed to help circumvent the unique reading challenges faced by individuals who live with distinct visual and motoric impairments. These individuals are unable, because of neurological damage, to isolate one line of text from the background of surrounding text. This condition is frequently compounded by an inability to eye-track in a steady, effective left to right motion. Concomitant disorders of gross and fine motoric impairment coupled with issues of motor planning, make it difficult for some of these individuals to manually hold and move devices which isolate lines of text. The reading machine of the present invention restores, to these affected individuals, a degree of independence in reading which has been lost through the combination of visual and physical disability.

2. Description of the Prior Art

Devices for isolating single lines of text on a printed page have long been known, particularly with regard tools or devices that aid typists in reading lines of copy.

For example, U.S. Pat. No. 4,043,064, which issued to Friedman on Aug. 23, 1977 for "Copyholder" discloses a copyholder that is operable both with copy having regular lines and copy having irregular lines having a first actuating device to move an indicator over copy in an adjustable but predetermined and regular manner and a second actuating device independent of the first actuating device to move the indicator continuously as long as it is actuated so that copy having irregularly spaced lines may also be readily copied. Similarly, U.S. Pat. No. 4,177,591, which issued to Thompson, et al. on Dec. 11, 1979 for "Copy holder" discloses a means of control for a copy holder, providing an electric-motor drive for each of a plurality of selected different paper-displacing increments, at least one of the increments being selectively adjustable to exactly match the line spacing unique to the particular paper from which the copy is to be made.

Another example of such a copy holder is disclosed in U.S. Pat. No. 4,317,565, which issued to Swette on Mar. 2, 1982 for "Transcription-copy feeder," in which a foot-operable electromechanical paper feeding device designed to display handwritten or printed information in continual serial line order for transcription to typewritten copy or computer terminal entry is taught. Still another example of such a copy reader is taught in U.S. Pat. No. 4,558,527, which issued to Schroedel, et al. on Dec. 17, 1985 for "Reading aid apparatus, especially a copyholder for typewriters." The patent to Schroedel, et al. discloses a reading aid in the form of a copyholder which has a holder cylinder of transparent material into which a copy to be transcribed is inserted and includes a support to rotatably locate the copyholder substantially in the typist's line of vision toward the keyboard and the typed line.

Automated devices are common in the field. For example, a "Reading assistance device for word processor" is disclosed in U.S. Pat. No. 4,875,179, which issued to Gelman on Oct. 17, 1989 for a reading assistance device for use within the video display terminal of a word processing system. The reading device subtends the video display terminal, receives paper with written subject matter, and displays selected portions of the paper to a user. It includes a drive for moving the paper through the housing, and an outlet through which the device discharges the paper. Similarly, U.S. Pat. No. 5,088,217, which issued to Canaday on Feb. 18, 1992 for "Line reader apparatus" discloses an apparatus wherein a line reader support housing is mounted to an articulated framework. The line reader housing includes a transparent reader bar in operative relationship with a step motor to effect vertical repositioning of the reader bar relative to an underlying sheet member. Another example includes U.S. Pat. No. 5,213,508, which issued to Turner, et al. on May 25, 1993 for "Textscan," which discloses a text scanning apparatus including a support structure to hold a sheet of material to be scanned in planar engagement with an upright copyboard support surface. Horizontally and vertically movable masks overlie the sheet material and traverse over the material in operator preselected incremental timed manner, to highlight the text according to the operator's selections. The system provides for full automatic, semiautomatic or manual modes of operation.

U.S. Pat. No. 5,219,381, which issued to Jacecko, Jr., et al. on Jun. 15, 1993 for "Attachable power-assisted copy indicator" discloses a power-assisted copy indicator that uses a driving means actuator to cause an indicator to move in one direction along its vertical axis, while a second driving means actuator causes the same indicator to move in the opposite direction along its vertical axis.

An automated device for advancing fan-folded paper is disclosed in U.S. Pat. No. 4,483,086, which issued to Abseck on Nov. 20, 1984 for "Scrolling display device for fan-folded printout paper." The scrolling display device includes a slanting easel display plane panel pivotally mounted at the forward edge of a shelf with idler rollers along its upper edge and idler pinch rolls supported by its rear face wherein a capstan roller driven by a variable speed reversible drive engages the idler pinch rolls to advance the upfolded sheet drawn from a storage bin up and over the panel to descend behind the panel for re-fan-folded storage on the shelf.

There are, however, very few reading machines directed to assist individuals with reading disorders or disabilities. An example of such a machine is shown in U.S. Pat. No. 5,584,698, which issued to Rowland on Dec. 17, 1996 for "Method and apparatus for improving the reading efficiency of a dyslexic," which discloses a teaching aid for increasing the reading efficiency of a dyslexic. The teaching aid comprises a transparent sheet of material having a plurality of horizontal color gradient that is placed over an area of text to be read. Preferably, each color gradient covers a single line of text. When the color gradient covers the text area, a less distracting environment is created and allows the dyslexic reader to more readily focus and concentrate on the lines of text.

Such devices however, fails to offer the unique advantages contemplated by the present invention.

SUMMARY OF THE INVENTION

Against the foregoing background, it is a primary object of the present invention to provide a reading machine that can be used to isolate individual lines of text on a printed page.

It is another object of the present invention to provide such a reading machine that allows a user with a reading disability to independently read a printed publication.

It is but another object of the present invention to provide such a reading machine that allows individuals with distinct visual and motoric impairments to isolate one line of text from the background of surrounding text.

It is yet another object of the present invention to provide such a reading machine that restores to individuals with neurological damage a degree of independence in reading which has been lost through the combination of visual and physical disability.

It is still yet another object of the present invention to provide such a reading machine in which the characters or words from adjacent lines of text do not interfere with the line of text being read by the user.

It is another object of the present invention to provide such a reading machine that may be used with books or magazines of practically any size.

It is yet another object of the present invention to provide such a reading machine that allows a user to automatically or manually scroll between lines of text on the page.

It is yet another object of the present invention to provide such a reading machine that allows for easy access to the publication being read so as to facilitate turning the pages of such publication.

To the accomplishments of the foregoing objects and advantages, the present invention, in brief summary, comprises a reading machine of the type having a carriage for temporarily receiving and retaining a publication such as a book, magazine or printed sheet, which carriage is slidably inserted into tracks supported by the main body of the reading machine so as to allow horizontal movement of the carriage relative to the main body of the reading machine. A continuous belt is supported by roller bearings disposed about the main body of the reading machine such that the belt covers the carriage when the carriage is attached to the reading machine. The belt includes a horizontal member having an opening therein, said opening extending through the belt itself and being of substantially the same size of a line of text such that the opening and belt may be used to isolate individual lines of text. The machine includes control means that include means for manually or automatically controlling the vertical displacement of the belt and the horizontal member by means of an electric motor or by means of a knob or handle.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
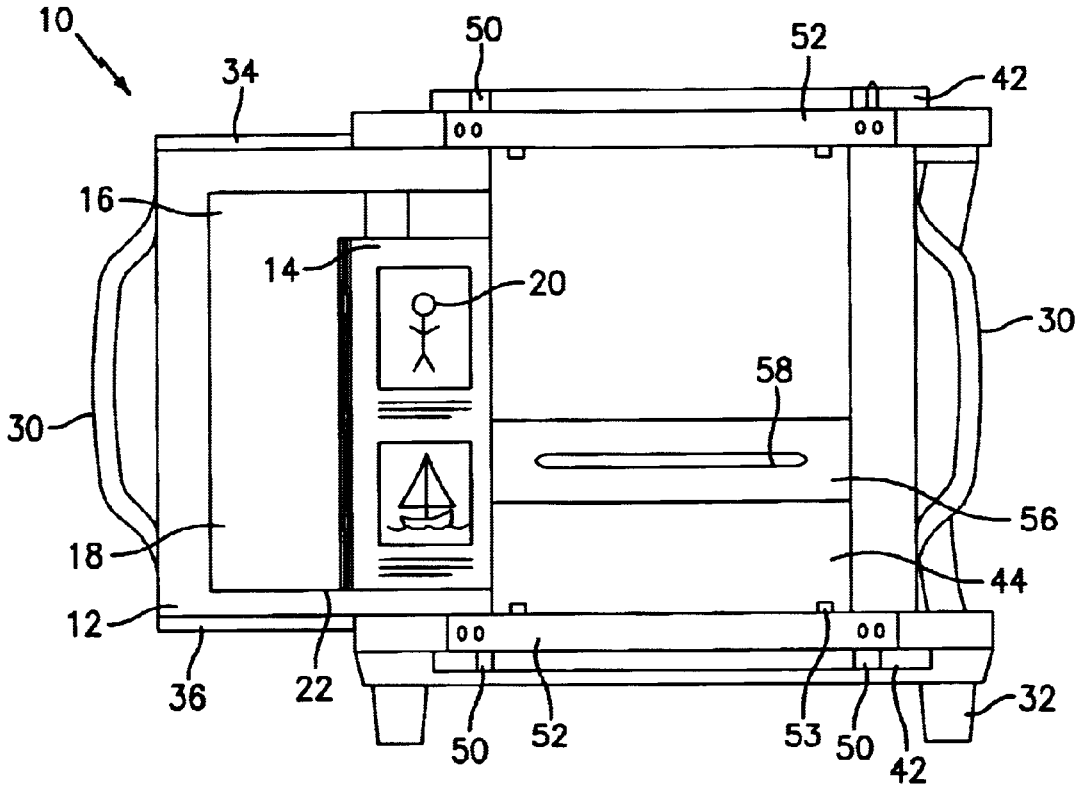
FIG. 1 is a front elevational view of the reading machine of the present invention.

Referring to the drawings and, in particular, to FIG. 1 thereof, the reading machine of the present invention is provided and is referred to generally by reference numeral 10. The machine 10 includes a carriage 12 adapted to receive and temporarily retain a publication 14 such as a book, magazine or printed sheet. The carriage 12 defines a cavity 16 within which the publication 14 may be temporarily secured, and wherein individual pages may be displayed. In the preferred embodiment, the cavity 16 is sufficiently large to accommodate a magazine or hard-cover book of the type typically read by children. It should be appreciated that the height of the cavity 16 should be at least as great as the height of such magazine or book, while the width of the cavity 16 must be at least twice as great as the width of such magazine or book, inasmuch as the publication 14 will be opened to a specified page. Furthermore, the depth of the cavity 16 must be at least as great as the thickness of the publication 14.

The carriage 12 includes a transparent window 18 through which the page of text 20 may be viewed and against which the publication may be pressed such that a substantial portion of the page of text 20 is in contact with the window 18. The publication 14 sits upon a horizontal shelf 22 at the bottom of the cavity, which shelf 22 holds the publication in a substantially horizontal position such that the lines of text are in a horizontal position. The necessity for the contact between the page of text 20 and the window 18, and the placement of the publication on the shelf 22 is predicated upon the fact that the reading machine 10 of the present invention is designed to assist in the reading of substantially horizontal lines of text. If the page of text 20 is not in contact with the window 18, or if the publication 14 is not seated in a substantially horizontal position on the shelf 22, the individual lines of text may be tilted or otherwise askew, thereby rendering the reading machine 10 ineffective. In addition, such position for the lines of text is confusing for the reader, particularly if the page of text 20 is rippled, folded or otherwise skewed.

Figure 2:
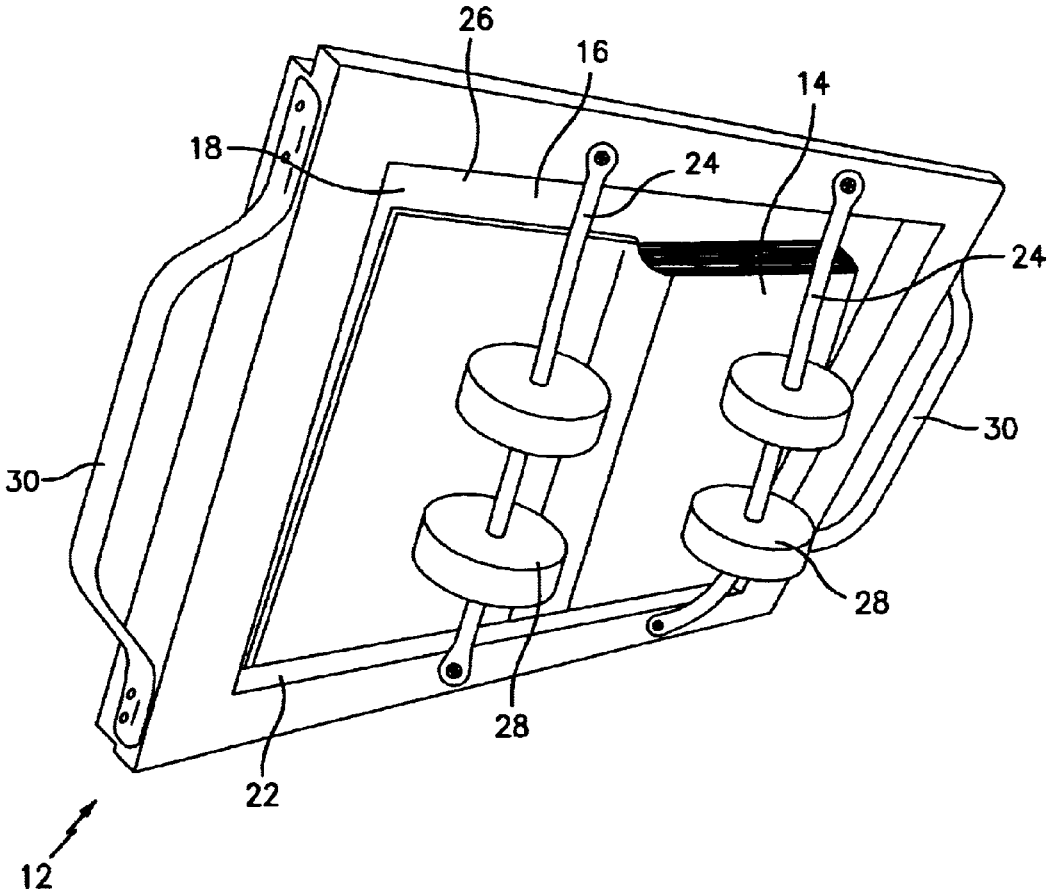
FIG. 2 is a front perspective view of the carriage of the reading machine of the present invention.

In the preferred embodiment, the publication 14 is retained within the cavity 16, and the page of text 20 pressed against the window 18, by means of at least one elastic element 24 disposed across the opening 26 to the cavity 16. Such elastic elements 24 may be stretched open so as to allow the passage of the publication 14 through the opening 26 into the cavity 16, and released so as to forcibly press the publication 14 against the window 18. In the embodiment illustrated in FIG. 2, two separate elastic elements 24 are utilized to hold the publication 14 in place and apply force thereto, which elements 24 further include two rotatable wheel members 28. These wheel members 28 facilitate the placement of the publication 14, as well as serving as extenders to maintain contact between the elastic elements 24 and thinner publications 14 such as magazines. In the preferred embodiment, the wheel members 28 are movable along the length of the elastic elements 24 so as to accommodate publications 14 of any size or shape.

Handles 30 may be disposed at either end of the carriage 12, which handles may be used to remove the carriage 12 from or insert the carriage 12 into the reading machine 12. Such handles 30 may also be utilized to facilitate the horizontal movement of the carriage 12 within the reading machine, which horizontal movement is necessary to align the page of text 20 within the reading machine 10, as well as changing from the left page to the right.

Although in the preferred embodiment, the publication 14 is held within the carriage 12 by means of the elastic elements 24, other means for receiving and retaining the publication 14 are contemplated, including the use of an enclosed carriage 12 having a hinged front opening or rear opening to allow the passage of a publication 14. Spring-type clasps or straps may also be utilized to hold the publication 14 in place.

The carriage 12, with or without the publication 14 inserted within the cavity 16, engages the base portion 32 of the reading machine 10 by slidably inserting upper and lower rails 34, 36 located at the top and bottom of the carriage 12 within complementary upper and lower channels 38, 40 located at the front of the base portion 32. The interaction between upper and lower rails 34, 36 and upper and lower channels 38, 40 allow the carriage 12 to be slidably moved along the length of the rails 34, 36 so as to properly position the carriage 12 within the base portion 32, as well as facilitating the removal or attachment of the carriage 12 so as to allow the placement of the publication 14 within the cavity 16. When inserted, the carriage 12 in the preferred embodiment is held in either a vertical or slanted position to facilitation the viewing of the publication 14 through the window 18, although a substantially horizontal position is also contemplated.

Figure 3:
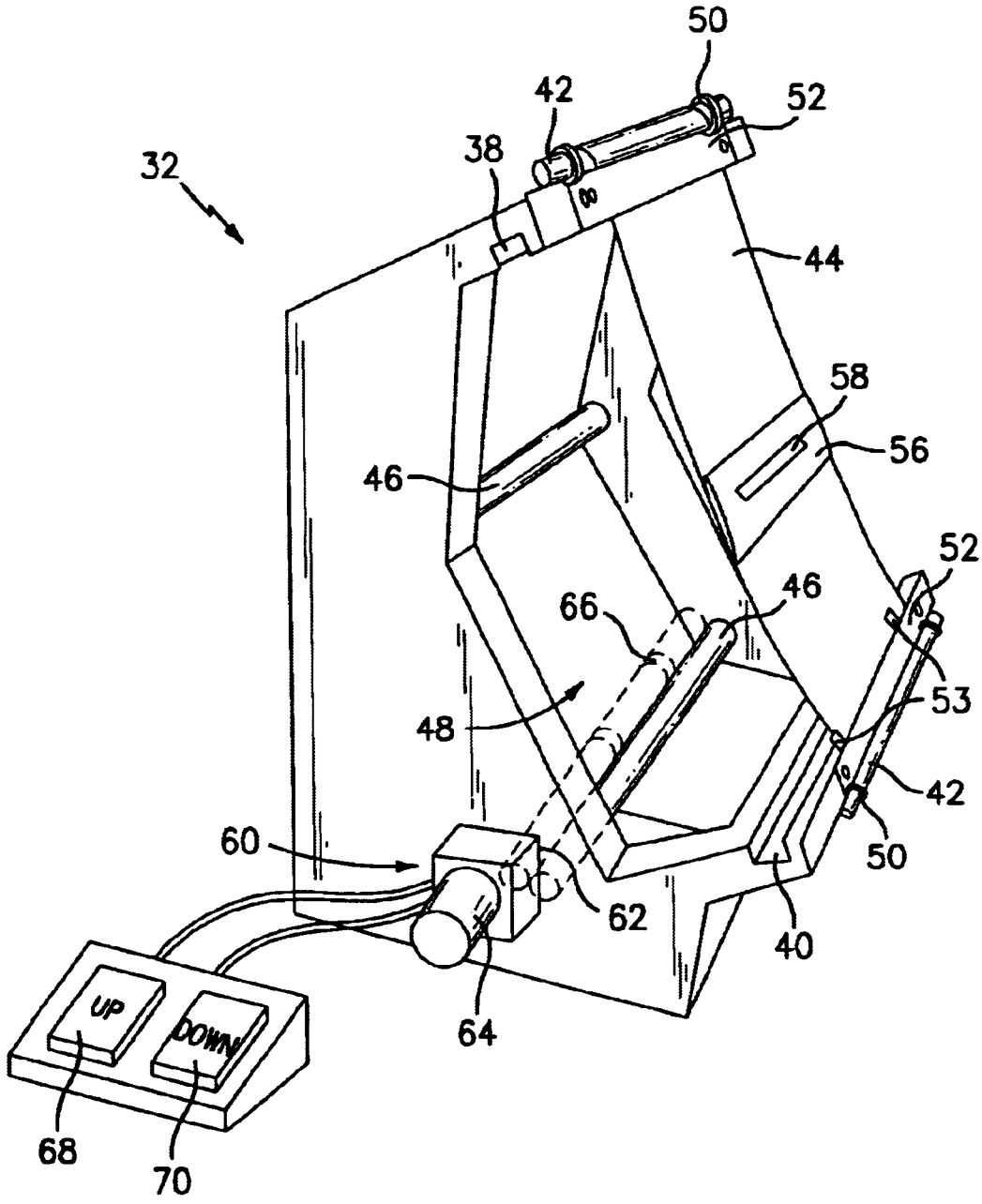
FIG. 3 is a side perspective view of the main body of the reading machine of the present invention.
Figure 4:
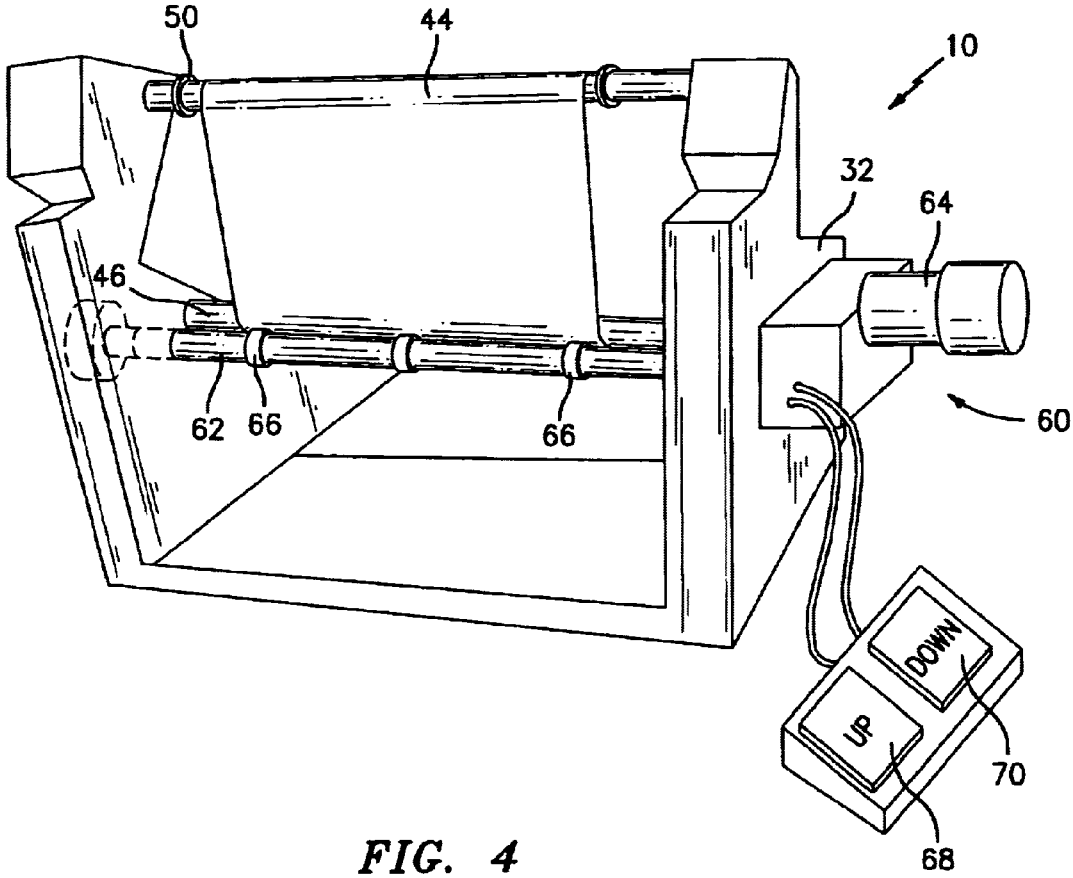
FIG. 4 is a bottom perspective view of the reading machine of the present invention showing the electric motor on the opposite side.

Positioned about the base portion 32 are at least two forward roller bearings 42 which support and guide a belt 44, which belt 44 in the preferred embodiment is continuous. At least one of the forward roller bearings 42 is situated on the base portion 32 above the position of the carriage 12 and at least one of the forward roller bearings 42 is situated on the base portion 32 below the position of the carriage 12. The front of said forward roller bearings 42 are co-planar with or raised slightly above the plane of the window 18 of the carriage 12 such that the belt 44 serves to cover all or a portion of the window 18, and any publication 14 stored in the cavity 16. In the preferred embodiment, at least two other rear roller bearings 46 are provided, for a total of four roller bearings 42, 46, said additional rear roller bearings 46 being situated within said base portion 32 so as to clear the belt 44 from the area within which the carriage 12 is inserted 48. Illustrated in FIG. 3 is the base portion 32 with the carriage 12 removed, showing the rear roller bearings 46 being used to pull the belt 44 back so as to clear the upper and lower channels 38, 40 and the carriage insertion area 48. It should be appreciated that while two such rear roller bearings 46 are used in the preferred embodiment, any number of such bearings 46 may be utilized so as to guide the belt 44 along practically any path. The only limitation as to the position of the bearings 42, 46, is that they must guide the belt 44 along an unobstructed path around the carriage 12, and allow the belt 44 to roll smoothly over the bearings 42, 46.

The belt 44 is kept in place and guided by flanges 50 at either end of bearings 42, 46, which flanges 50 serve to prevent the belt 44 from moving axially along the roller bearings 42, 46 and potentially damaging either the belt 44 or the reading machine 10 itself.

Disposed horizontally across the surface of the belt 44 is a viewing pane 56, which viewing pane 56 includes a horizontal slot-shaped opening 58 that extends through both the viewing pane 56 and the belt 44. Inasmuch as it is this opening 58 that serves to isolate the individual lines of text on the page 20, the length of the opening 58 must be at least as long as the length of the text on the page 20, while the height of the opening 58 must be at least as great as the height of the line of text, but not so great as to allow portions of adjacent lines of text to intrude within the opening 58. In order to accommodate text of any size, several different viewing panes 56 may be provided, each of which has an opening 58 of a different size, which viewing panes 56 may be interchangeably attached to the belt 44 using any conventional attachment means such as a slidable mask, snaps, clasps, or hook and loop fasteners.

It should be appreciated that in order to block out the extraneous material on the page of text 20, the width of the belt 44 should be at least as great as the width of the viewing pane 56, which in turn must be wider than the page of text 20 so that the opening 58 can accommodate the full line of text. Furthermore, the belt 44 should be composed of a an opaque material so as to be able to block out anything that it is covering, while also being flexible enough to be maneuvered about the roller bearings 42, 46.

While the belt 44 with viewing pane 56 may be utilized without any automated means for scrolling the viewing pane 56 up or down the page of text 20 simply by pulling the belt 44 along the roller bearings 42, 46, in the preferred embodiment, the reading machine 10 includes an automated drive means 60 for moving the belt 44. Said drive means 60 comprises a drive shaft 62 coupled with an electric motor 64. The drive shaft 60 is located adjacent to one of the rear roller bearings 46 and the belt 44 is threaded therebetween such that the drive shaft 60 is always in frictional contact with the belt 44 by virtue of the fact that the belt 44 is slightly compressed between the rear roller bearing 46 and drive shaft 60. One or more frictional members 66 may be disposed about the drive shaft 62 so as to increase the coefficient of friction between the drive shaft 62 and belt 44, thereby preventing any slippage between these two elements. Examples of frictional members 66 include rubber rings and the like.

While in the preferred embodiment an electric motor 64 is used to drive the drive shaft 62, it should be appreciated that a manual driving means, such as a knob or wheel, may also be used, which manual driving means allows the user to turn the knob or wheel so as to drive the belt 44 and advance the viewing pane 56.

The electric motor 64 is controlled by control switches 68, 70, one of which is for advancing the viewing pane 56 down the page of text 20, the other of which is for retreating back up the page of text 20. In the preferred embodiment, these switches 68, 70 are either be hand or foot operated, although other control means are contemplated, including switches 68, 70 that may be operated by blowing or merely by focusing one's line of sight. These control switches 68, 70 are electronically connected with the electric motor 64 such that depressing the first switch 68 sends an electric signal to drive the motor 64 forward, thereby rotating the drive shaft 62 in one direction and causing the belt 44 to advance, and depressing the other switch 70 sends a different signal to drive the motor 64 backward, thereby rotating the drive shaft 62 in the other direction and causing the belt 44 to retreat.

The automated drive means 60 may be programmed to advance the belt 44 any distance by merely changing the number of rotations through which the motor 64 drives the drive shaft 62. For example, the drive means 60 may be programmed to advance the belt 44 one half inch with each depression of the control switches 68, 70 so as to automatically advance one line of text at a time. Alternatively, the drive means 60 may be programmed to advance the belt 44 incrementally, such as in 1/32 inch increments, thereby allowing the user to manually advance the belt 44 and the viewing pane 56 until the line of text is visible through the opening 58. Of course, a combination of both methods may also be employed, whereby a second set of switches 72, 74 (not shown) is utilized, the first set 68, 70 being used to automatically advance the viewing pane 56 a set distance, while the second set of switches 72, 74 is used to "fine tune" the placement of the opening 58.

Belt stays 52 are also positioned on the base portion 32 on the front surface 54 of the upper and lower channels 38, 40.

The belt stays 52 are substantially planar elements that are bolted on either side of the belt 44 to the front surface 54 of the base portion 32 and include sensors 53 which are designed to detect contact between the belt stays 52 and the viewing pane 56. In the event that the belt 44 is moved such that the viewing pane 56 comes into contact with one of the belt stays 52, the sensors 53 send instruction to the electric motor 64 to disable the control switch 68 or 70 in that direction and only allowing the operation of the other control switch 70 or 68, thereby preventing damage to the belt 44 and the viewing pane 56.

Having thus described the invention with particular reference to the preferred forms thereof, it will be obvious that various changes and modifications can be made therein without departing from the spirit and scope of the present invention as defined by the appended claims.

We claim:

1. A reading machine for isolating a single line of text on a printed page of a publication and masking out all other text or figures on said printed page, said reading machine comprising:

a base portion;

a carriage for temporarily receiving said publication, said carriage including means for displaying said printed page, wherein said carriage is adapted to be removably attached to said base portion such that said carriage may be slidably movable in a horizontal direction relative to said base portion;

a belt movably attached to said base portion, wherein said belt substantially covers said printed page of said publication but for said single line of text when said publication is stored within said carriage and said carriage is attached to said base portion, wherein said belt includes a slot-shaped opening therethrough for viewing said single line of text; and means for moving said belt to thereby move said slot-shaped opening from one line of text to another.

2. The reading machine of claim 1, wherein said means for displaying comprises a transparent window.

3. The reading machine of claim 2, wherein said carriage defines a cavity within which said printed publication may be retained.

4. The reading machine of claim 3, wherein said cavity is bounded on the bottom by a horizontal shelf upon which said printed publication may be seated.

5. The reading machine of claim 4, wherein said carriage includes means for receiving and retaining said publication, said means further serving to impress said printed page against said transparent window.

6. The reading machine of claim 1, wherein said carriage includes upper and lower rails and said base portion includes upper and lower channels corresponding to said upper and lower rails, wherein said upper and lower rails are adapted to be slidably inserted into said upper and lower channels to thereby attach said carriage to said base portion while allowing said carriage to be movable in a horizontal direction relative to said base portion.

7. The reading machine of claim 6, further including at least one forward roller bearing disposed about said upper channel and said lower channel, said roller bearing being adapted to guide said belt while allowing said belt to be movable in a direction up and down said printed page.

8. The reading machine of claim 7, further including at least one rear roller bearing disposed behind said forward roller bearings, said rear roller bearing engaging said belt so as to create an opening inside the belt loop within which said carriage may be slidably inserted.

9. The reading machine of claim 8, wherein said means for moving comprises an electric motor coupled with a drive shaft.

10. The reading machine of claim 9, wherein said rear roller bearing and said drive shaft are immediately adjacent to each other and wherein said belt is threaded therebetween such that said drive shaft is always in frictional contact with said belt.

11. The reading machine of claim 10, further including control switches electrically connected with said motor, said control switches adapted to send a signal to said motor to operate in either the clockwise or counter-clockwise direction.

12. The reading machine of claim 11, wherein said means for moving includes means for moving said belt a predetermined distance.

13. The reading machine of claim 8, wherein said means for moving comprises a knob coupled with a drive shaft, wherein said rear roller bearing and said drive shaft are immediately adjacent to each other and wherein said belt is threaded therebetween such that said drive shaft is always in frictional contact with said belt.

14. A reading machine for isolating single lines of text on a printed page of a publication and masking out all other text or figures on said printed page, said reading machine comprising:

a base portion;

a carriage for temporarily receiving said publication, said carriage including means for displaying said printed page comprising a transparent window, wherein said carriage defines a cavity bounded on the bottom by a horizontal shelf within which said printed publication may be retained, and wherein said carriage is adapted to be removably attached to said base portion by means of engagement of upper and lower rails disposed on said carriage with complementary upper and lower channels disposed on said base such that said carriage may be slidably movable in a horizontal direction relative to said base portion;

a belt movably attached to said base portion by means of at least two roller bearings, wherein said belt covers at least a portion of said printed page of said publication when said publication is stored within said carriage and said carriage is attached to said base portion, wherein said belt includes a slot-shaped opening therethrough for viewing said single lines of text; and means for moving said belt to thereby move said slot-shaped opening from one line of text to another.

15. The reading machine of claim 14, wherein said means for moving comprising an electric motor coupled with a drive shaft for engaging said belt.

16. The reading machine of claim 14, wherein said means for moving comprising a manually operated knob for engaging said belt.

17. A reading machine for individuals with distinct visual and motoric impairments who are unable, because of neurological damage, to isolate a single line of text from a background of surrounding text or figures on a printed page of a publication, said reading machine comprising:

a base portion;

a carriage for temporarily receiving said publication, said carriage including means for displaying said printed page, wherein said carriage is adapted to be removably attached to said base portion such that said carriage may be slidably movable in a horizontal direction relative to said base portion;

a belt movably attached to said base portion, wherein said belt substantially covers said printed page of said publication but for said single line of text when said publication is stored within said carriage and said carriage is attached to said base portion, wherein said belt includes a slot-shaped opening therethrough for viewing said single line of text; and means for moving said belt to thereby move said slot-shaped opening from one line of text to another.

18. The reading machine of claim 17, wherein the size of said slot-shaped opening may be changed.

* * * * *